US005585809A

United States Patent [19]

Yajima et al.

[11] Patent Number: 5,585,809

[45] Date of Patent: Dec. 17, 1996

[54] ANTENNA UNIT FOR A CAR NAVIGATION DEVICE

[75] Inventors: Hideo Yajima; Toshikazu Ogino, both of Kanagawa, Japan

[73] Assignee: Mitsumi Electric Co., Ltd., Tokyo, Japan

[21] Appl. No.: 450,579

[22] Filed: May 25, 1995

[30] Foreign Application Priority Data

May 31, 1994 [JP] Japan ..... 6-141260

[51] Int. Cl.[6] ..... H01Q 1/32

[52] U.S. Cl. ..... 343/713; 343/878; 248/683; 248/206.5

[58] Field of Search ..... 343/713, 841, 343/878; 248/309.4, 683, 467, 206.5; H01A 1/32

[56] References Cited

U.S. PATENT DOCUMENTS 3,245,165 4/1966 Podoloff ..... 248/467

3,910,540 10/1975 Kayler ..... 248/206

*Primary Examiner*—Hoanganh T. Le

*Attorney, Agent, or Firm*—Whitham, Curtis, Whitham & McGinn

[57] ABSTRACT

An antenna unit for a car navigation device includes a unit casing accommodating a circuit board and an antenna body and having a bottom cover in which a bottom recess is formed. A permanent magnet ring magnetically held on a back yoke is fixedly set in the bottom recess, the permanent magnet ring being used to magnetically hold the bottom cover on the surface of an object so that the antenna unit is detachably mounted on the object. In the antenna unit, an adhesive seal is bonded to the of the permanent magnet ring which surface confronts the surface of the object.

16 Claims, 2 Drawing Sheets

ANTENNA UNIT FOR A CAR NAVIGATION DEVICE

BACKGROUND OF THE INVENTION

1. Field of the Invention

This invention relates to an improvement of a receiving antenna unit for a car navigation device.

3. Related Art

A conventional receiving antenna unit in a car navigation system is as shown in FIGS. 3 and 4. The receiving antenna unit is magnetically held on the surface of an object such as the roof panel X of an automobile when necessary. The receiving antenna unit comprises: a unit casing 2A whose bottom is covered with a bottom cover 1A which is a die casting of aluminum; a circuit board 3A on which a number of circuit elements are mounted; a metal shield cover 11A covering the circuit board 3A; and an antenna body 4A for receiving radio waves from for instance a geostationary satellite. The circuit board 3A, the metal shield cover, and the antenna body 4A are built in the unit casing 2A.

In order to detachably mount the antenna unit on the surface of an object and more specifically, in order to magnetically hold it on the object, a bottom recess 5A is formed in the bottom of the bottom cover 1A, and a back yoke 7A of ferromagnetic material is fixedly set in the bottom recess 5A with a plurality of fixing screws 6A. The back yoke 7A, which is set in the bottom recess 5A, has a plurality of mounting pieces 7*a* which are extended from its outer periphery, and are suitably bent. Thus, the permanent magnet ring 8A is magnetically held to the surface of the back yoke 7A. That is, the magnetic force of the permanent magnetic ring 8A is utilized to mount the antenna unit on the roof panel X of the automobile.

In the antenna unit thus mounted, the permanent magnet ring 8A is magnetically held on the surface of the back yoke 7A with a gap H between the roof panel X and the permanent magnet ring 8A. That is, the antenna unit is held on the surface of an object such as the roof panel X by the magnetic force of the permanent magnet ring 8A.

However, the antenna unit, being designed as described above, suffers from the following difficulty. When the antenna unit is vibrated greatly for instance during the travelling of the automobile, the permanent magnet ring 8A may be unable to maintain the aforementioned gap H being temporarily separated from the back yoke 7A. In this case, the permanent magnet ring 8A is magnetically stuck onto the surface of the roof panel X. If, under this condition, the antenna unit is removed by hand, then sometimes the permanent magnet ring 8A is left on the roof panel X.

SUMMARY OF THE INVENTION

In view of the foregoing, an object of the invention is to provide an antenna unit for a car navigation device which is free from the above-described difficulty that the permanent magnet ring is left on the surface of the object when the antenna unit is vibrated or mechanically shocked.

The foregoing object of the invention has been achieved by the provision of an antenna unit for a car navigation device which comprises: a unit casing accommodating a circuit board and an antenna body and having a bottom cover in which a bottom recess is formed; and a permanent magnet ring magnetically held on a back yoke fixedly set in the bottom recess, the permanent magnet ring being used to magnetically hold the bottom cover on the surface of an object so that the antenna unit is detachably mounted on the object, wherein an adhesive seal is bonded to the surface of the permanent magnet ring which surface confronts the surface of the object.

As is apparent from the present invention, the difficulty that the permanent magnet ring is left on the object when the antenna unit is removed therefrom by hand is eliminated merely by bonding the adhesive seal to the outer surface of the permanent magnet ring. In addition, the surface of the permanent magnet ring is covered with the adhesive seal, which improves the external appearance of the antenna unit and reduces the manufacturing cost of the antenna.

DETAILED DESCRIPTION OF THE PREFERRED EMBODIMENT

One preferred embodiment of the invention will be described with reference to FIGS. 1 and 2 in detail.

Figure 1:
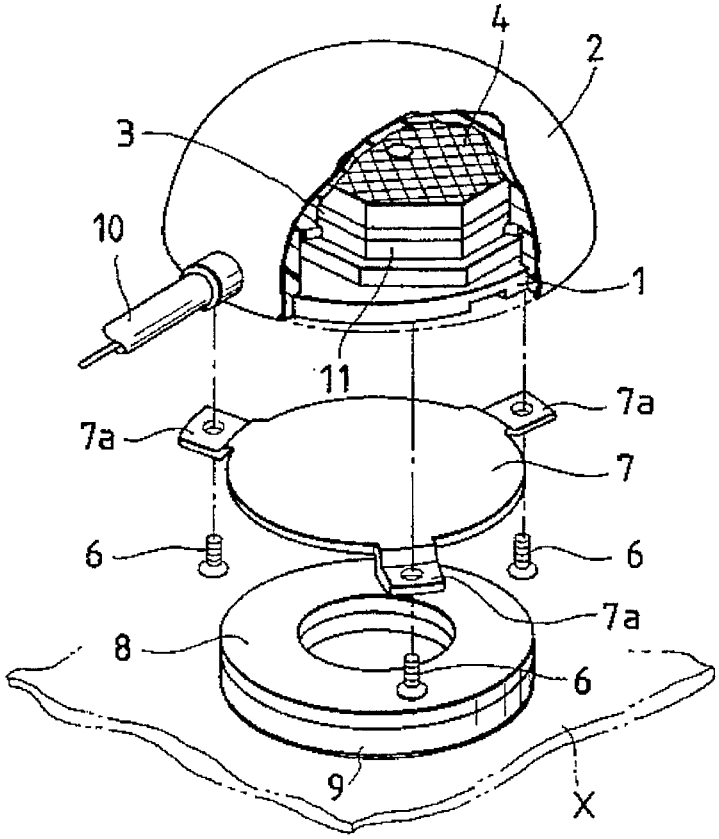
FIG. 1 is an exploded perspective view, partially cut away, showing an antenna unit for a car navigation device according to the invention.

FIG. 1 shows an antenna unit of the invention which is miniaturized. In the antenna unit of the invention, a unit casing 2 whose bottom is covered with a bottom cover 1 which is a die casting of aluminum incorporates a circuit board 3 on which a number of circuit elements are mounted, a metal shield cover 11 covering the circuit board 3, and an antenna body 4 for receiving radio waves from for instance a geostationary satellite.

In addition, the bottom cover 1 has a bottom recess 5, in which a back yoke 7 of ferromagnetic material is set. The back yoke 7 has a plurality of mounting pieces 7*a* which are secured to the bottom cover 1 with a plurality of fixing screws 6. A circular permanent magnet ring 8 is magnetically held on the back yoke 7.

A specific feature of the embodiment resides in the employment of an adhesive seal 9 which is stuck onto the surface of the permanent magnet ring 8 which surface confronts the surface of an object on which the antenna unit is set, namely, a roof panel X in the embodiment. Characters, or color patterns may be printed on the surface of the adhesive seal 9. The thickness of the adhesive seal 9 should be larger than the gap H formed between the circular permanent magnet ring 8 and the roof panel X. Preferably the adhesive seal 9 has an elastic layer such as a sponge layer which, when set free, has a thickness sufficiently larger than the gap H. The use of the adhesive seal 9 having the elastic layer is advantageous in that the coated surface of the roof panel X is prevented from being scratched by the antenna unit.

Figure 2:
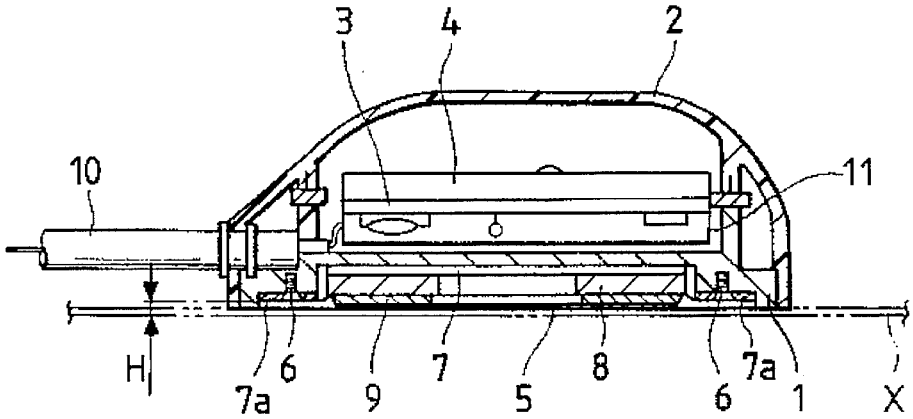
FIG. 2 is a vertical sectional view of the antenna unit shown in FIG. 1.
Figure 3:
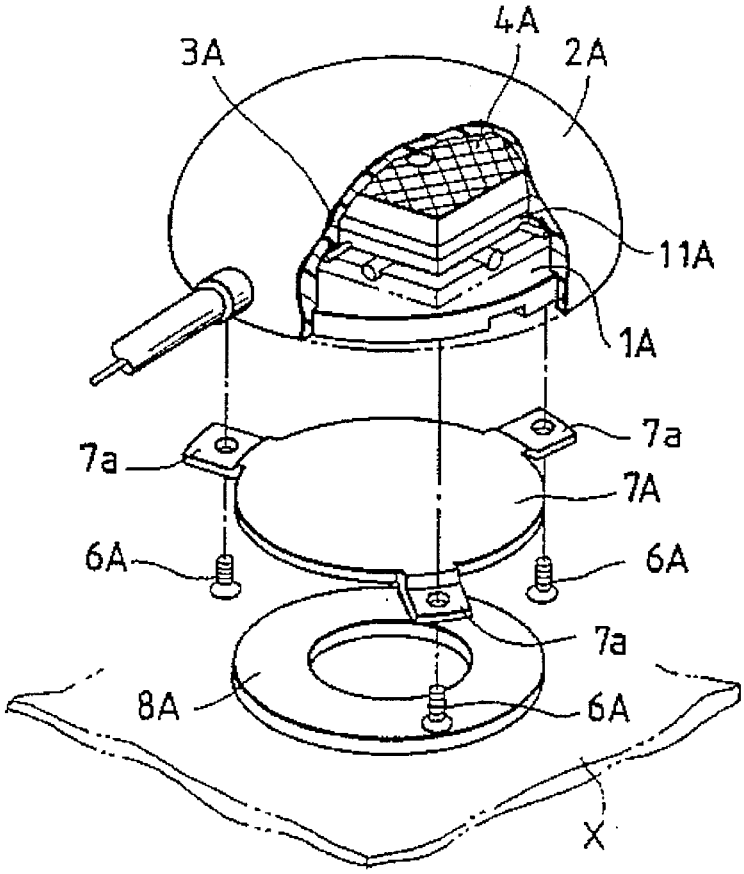
PRIOR ART FIG. 3
FIG. 3 is an exploded perspective view showing a conventional antenna unit for a car navigation device.
Figure 4:
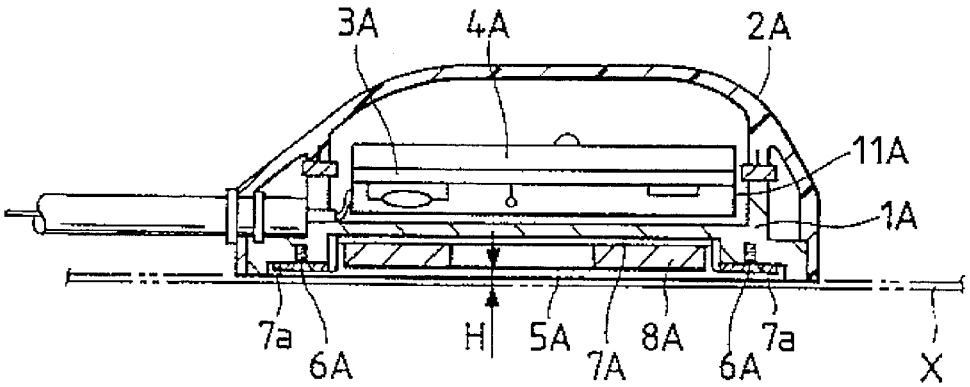
FIG. 4 PRIOR ART
FIG. 4 is a vertical sectional view of the conventional antenna unit shown in FIG. 3.

In FIGS. 1 and 2, reference numeral 10 designates an antenna cord connected between the antenna unit and the car navigation device.

The antenna unit of the invention is designed as described above. That is, the thick adhesive seal 9 is bonded to the surface of the permanent magnet ring 8. Hence, even when the antenna unit is vibrated or mechanically shocked, the presence of the adhesive seal 9 maintains the gap H between the permanent magnet ring 8 and the roof panel X. Hence, the permanent magnet ring 8 is magnetically attracted towards the back yoke 7 more than towards the roof panel X at all times. That is, the permanent magnet ring 8 is magnetically held on the back yoke 7. This feature eliminates the difficulty that, when the antenna unit is removed by hand, the permanent magnet ring 8 is left on the roof panel X.

The outer surface of the permanent magnet ring 8, which is visible from outside, is covered with the adhesive seal 9. Hence, even when the permanent magnet ring 8 oxidizes, it retains its in external appearance. On the other hand, a manufacture number etc. can be readily printed on the adhesive seal 9, which contributes to a reduction of the manufacturing cost.

As is apparent from the above description, the difficulty that the permanent magnet ring is left on the object when the antenna unit is removed therefrom by hand is eliminated merely by bonding the adhesive seal to the outer surface of the permanent magnet ring. In addition, the surface of the permanent magnet ring is covered with the adhesive seal, which improves the external appearance of the antenna unit and reduces the manufacturing cost of the antenna.

What is claimed is:

1. An antenna unit for a car navigation device for attachment to a magnetically-attractive object, comprising:

a unit casing for accommodating a circuit board and an antenna body and having a bottom cover in which a bottom recess is formed;

a permanent magnet magnetically held on a back yoke and not adhesively attached to said back yoke which is fixedly set in said bottom recess, said permanent magnet for magnetically holding said bottom cover on a surface of said magnetically-attractive object so that said antenna unit is detachably mounted on said magnetically-attractive object; and an adhesive seal bonded to a surface of said permanent magnet which confronts the surface of said magnetically-attractive object, wherein said adhesive seal adjusts a gap between said surface of said magnetically-attractive object and a surface of said permanent magnet such that said permanent magnet is magnetically attracted toward said back yoke more than towards said magnetically-attractive object.

2. An antenna unit according to claim 1, wherein said adhesive seal has a thickness larger than a gap formed between said permanent magnet and said surface of said magnetically-attractive object.

3. An antenna unit according to claim 1, wherein said adhesive seal has an elastic layer which has a free-standing thickness larger than that of a gap formed between said permanent magnet and said surface of said magnetically-attractive object.

4. An antenna unit according to claim 1, wherein said adhesive seal has a sponge layer having a thickness larger than that of a gap formed between said permanent magnet and said surface of said magnetically-attractive object.

5. An antenna unit according to claim 1, wherein said adhesive seal has substantially a same shape as said permanent magnet.

6. An antenna unit according to claim 1, wherein said adhesive seal has a sponge layer having a thickness larger than that of a gap formed between said magnet and said surface of said magnetically-attractive object, and wherein said adhesive seal has substantially a same shape as said permanent magnet.

7. An antenna unit for a car navigation device for attachment to a magnetically-attractive object, comprising:

a substantially hemispherically-shaped unit casing;

a back yoke covered with a bottom of said unit casing, said back yoke having a bottom recess;

a circuit board on which a plurality of circuit elements are mounted, said circuit board being mounted in said unit casing;

a metal shield cover covering said circuit board;

an antenna body mounted on said circuit board;

a permanent magnet magnetically held on a back yoke and not adhesively attached to said back yoke which is fixedly set in said bottom recess, said permanent magnet for magnetically holding said back yoke on a surface of said magnetically-attractive object so that said antenna unit is detachably mounted on said magnetically-attractive object; and a magnetic force adjusting member for adjusting a gap between said surface of said magnetically-attractive object and a surface of said permanent magnet such that said permanent magnet is magnetically attracted toward said back yoke more than towards said magnetically-attractive object, wherein said magnetic force adjusting member comprises an adhesive seal bonded to a surface of said permanent magnet.

8. An antenna unit for a car navigation device as claimed in claim 7, wherein said magnetic force adjusting member includes an adhesive seal bonded to the surface of said permanent magnet, a surface of said adhesive seal confronting the surface of said magnetically-attractive object.

9. An antenna unit according to claim 7, wherein said magnetic force adjusting member comprises an adhesive seal, said adhesive seal having a thickness larger than a gap formed between said permanent magnet and said surface of said magnetically-attractive object.

10. An antenna unit according to claim 7, wherein said magnetic force adjusting member comprises an adhesive seal, said adhesive seal having an elastic layer which has a free-standing thickness larger than that of a gap formed between said permanent magnet and said surface of said magnetically-attractive object.

11. An antenna unit according to claim 7, wherein said magnetic force adjusting member comprises an adhesive seal, said adhesive seal having a sponge layer having a thickness larger than that of a gap formed between said permanent magnet and said surface of said magnetically-attractive object.

12. An antenna unit according to claim 7, wherein said magnetic force adjusting member comprises an adhesive seal, said adhesive seal having substantially a same shape as said permanent magnet.

13. An antenna unit for a navigation device for attachment to a magnetically-attractive object, comprising:

a casing for accommodating an antenna body and having a bottom cover in which a bottom recess is formed;

a magnet magnetically held on a back yoke and not adhesively attached to said back yoke which is fixedly set in said bottom recess, said magnet for magnetically holding said bottom cover on a surface of said magnetically-attractive object so that said antenna unit is detachably mounted on said magnetically-attractive object; and a seal bonded to a surface of said magnet which confronts the surface of said magnetically-attractive object, wherein said magnet comprises a permanent magnet and wherein said seal adjusts a gap between said surface of said magnetically-attractive object and a surface of said permanent magnet such that permanent magnet is magnetically attracted toward said back yoke more than towards said magnetically-attractive object.

14. An antenna unit according to claim 13, wherein said seal comprises an adhesive seal and said casing has a substantially hemispherical-shape.

15. An antenna unit according to claim 13, wherein said seal has a thickness larger than a gap formed between said magnet and said surface of said magnetically-attractive object.

16. An antenna unit according to claim 13, wherein said seal has an elastic layer which has a free-standing thickness larger than that of a gap formed between said magnet and said surface of said magnetically-attractive object.

* * * * *